US005379976A

United States Patent [19]

DeGirolamo

[11] Patent Number: 5,379,976

[45] Date of Patent: Jan. 10, 1995

[54] WALL MOUNTING SYSTEM

[75] Inventor: Nicola DeGirolamo, 28 Winslow Rd., Martinsville, N.J. 08836

[73] Assignee: Nicola DeGirolamo, Martinsville, N.J.

[21] Appl. No.: 106,426

[22] Filed: Aug. 13, 1993

[51] Int. Cl.[6] ..... A47K 1/00

[52] U.S. Cl. ..... 248/221.2; 248/222.2

[58] Field of Search ..... 248/221.2, 220.4, 220.2, 248/243, 220.3, 222.2; 211/87

[56] References Cited

U.S. PATENT DOCUMENTS

| | | | |
|---|---|---|---|
| 2,498,623 | 2/1950 | Poupitch . | |
| 2,913,210 | 11/1959 | Tichnor | 211/87 X |
| 2,942,364 | 6/1960 | Horton | 211/87 X |
| 3,193,225 | 7/1965 | Terlinde | 248/221.2 |
| 3,315,816 | 4/1967 | Mallory . | |
| 3,425,889 | 2/1969 | willits, Jr. | 248/221.2 |
| 3,516,552 | 6/1970 | Salava | 248/220.3 X |
| 3,813,070 | 5/1974 | Hanson | 248/223 |
| 4,155,461 | 5/1979 | Young, Jr. | 248/220.2 X |
| 4,189,123 | 2/1980 | Johnson | 248/220.2 |
| 4,204,480 | 5/1980 | Hanna | 248/224.4 |
| 4,211,379 | 7/1980 | Morgan et al. | 248/222.2 |
| 4,509,648 | 4/1985 | Govang et al. | 248/220.2 X |
| 4,678,151 | 7/1987 | Radek | 248/220.2 |
| 4,809,940 | 3/1989 | Trestyn | 248/220.4 |
| 4,817,900 | 4/1989 | Whittington et al. | 248/223.4 X |
| 4,898,354 | 2/1990 | whittington et al. | 248/223.4 X |
| 4,932,538 | 6/1990 | Gambello | 248/222,2 X |
| 5,138,803 | 8/1992 | Grossen | 248/220.3 X |
| 5,185,971 | 2/1993 | Johnson, Jr. | 248/243 X |

FOREIGN PATENT DOCUMENTS

| | | | |
|---|---|---|---|
| 0710030 | 6/1954 | United Kingdom | 248/221.2 |

*Primary Examiner*—Ramon O. Ramirez

*Attorney, Agent, or Firm*—Lerner, David, Littenberg, Krumholz & Mentlik

[57] ABSTRACT

A wall mounting system for commercial and residential uses is disclosed. The wall mounting system comprises brackets which are adapted to be securely mounted on a wall fixture. The bracket may be used to support a variety of articles thereon. The wall fixture includes a plurality of elongate apertures which are sized to correspond to the width of mounting portions of the brackets.

16 Claims, 4 Drawing Sheets

WALL MOUNTING SYSTEM

FIELD OF THE INVENTION

The present invention relates to mounting systems. More particularly, the present invention relates to wall mounting systems wherein brackets, or other structures, are firmly mounted on a corresponding wall fixture so that various articles can be displayed thereon.

BACKGROUND OF THE INVENTION

Wall mounting systems including brackets, or other display support structures, for supporting shelves thereon are commonly used in commercial establishments and residential homes to display various articles. In fact, such devices are so widely demanded that inventors have expended great effort in designing and developing improvements to them. For example, U.S. Pat. No. 4,932,538 to Gambello; U.S. Pat. No. 4,817,900 to Whittington et al.; and U.S. Pat. No. 4,211,379 to Morgan et al. disclose mounting systems which are indicative of the efforts made by prior art inventors. Despite the crowded nature of the mounting system art and the past efforts of many inventors, problems relating to adequately securing brackets, or other support structures, in wall mountable panels have continued to exist. As used in this application, the word "bracket" pertains to any type of support structure that can be connected to a wall fixture and that can be used to support any type of article. For example, the bracket may have a planar surface for supporting a shelf. Alternatively, the bracket may have hooks, rods, or any other type of support member that can be used in connection with the display of many types of articles such as clothing, belts, pictures, other decorative items, etc.

More particularly, there has been a deficiency in adequately securing supporting hardware in all known prior art devices that employ wall fixtures and display support structures for displaying merchandise. The present invention solves the aforementioned problems or prior art devices by providing a wall mounting system which includes a novel wall fixture which has support structures such as means for securely mounting brackets on wall fixtures.

SUMMARY AND OBJECTS OF THE INVENTION

One aspect of the present invention pertains to a wall mounting system which comprises bracket means for supporting at least one article thereon. The bracket means includes a central member which extends in a vertical plane, and a plurality of mounting members which are attached to the central member at spaced locations thereon. Each of the mounting members have at least one horizontally extending portion arranged to extend along a horizontal plane generally transverse to the central member from an inner side thereof. The mounting members have a generally planar surface which defines a predetermined width thereacross. The bracket means also includes an article support member attached to the central member and extending outwardly from the outer side thereof. The mounting system also includes wall fixture means for supporting the bracket means thereon, wherein the wall fixture means comprises an internal surface and an external surface and has a plurality of elongate apertures extending between the internal and external surfaces for receiving corresponding ones of the mounting members therein.

The elongate apertures have a width which substantially corresponds to the width of the planar surfaces of the mounting members so that the bracket means is firmly mounted on the wall fixture means when arranged in assembled position thereon. Preferably, the wall fixture means is adapted to be secured to a wall. However, it may be a portion of a wall itself.

In one preferred embodiment, the plurality of mounting members comprises an upper member and a lower member wherein the upper member is L-shaped and includes a locking member extending transverse to the horizontally extending portion. The locking member is integral with the horizontally extending portion and is spaced from the inner side of the central member a distance substantially corresponding to the thickness of the wall fixture means between the internal surface and the external surface thereof so that when the locking member extends through a corresponding elongate aperture it thereby engages the internal surface of the wall fixture means so as to stabilize the bracket means therein.

In another preferred embodiment, the distance between the upper and lower members is selected so that the inner surface of the central member abuts the external surface of the wall fixture means when the bracket means is arranged in assembled position.

It is preferable for the central member to extend downwardly to a location below the lower support member.

In another preferred embodiment, the upper support member is integrally connected to the central member at the vertical most location thereon. In still another preferred embodiment, the wall fixture means is made of a fibrous material and may comprise wood panels, particleboard, veneer or any combination of these materials or like materials such as plastic, metal, etc.

In yet another preferred embodiment, the wall fixture means comprises at least one parallelopiped structure. The at least one parallelopiped structure includes a central cavity therein. In this preferred embodiment, the locking members are arranged within a corresponding one of the plurality of apertures and a corresponding central cavity when the bracket means is in assembled position on the wall fixture means.

In still another preferred embodiment, the article support member of the bracket means may comprise a shelf support member having a center axis parallel to the horizontal planes of the plurality of mounting members. The shelf support member may have an upper surface adapted to support a shelf thereon and a lower surface.

In still another preferred embodiment, the article support member may comprise at least one elongate member adapted to support at least one article thereon. In still another preferred embodiment, the article support member may be a picture holder.

In yet another preferred embodiment, the wall fixture means may comprise a pair of parallelopiped structures arranged on a wall at predetermined distances from each other so that each shelf to be supported thereon can extend between article support members of corresponding bracket means.

Accordingly, it is an object of the present invention to provide a wall mounting system wherein the brackets thereof can be more securely mounted on the wall fixtures than has heretofore been achieved.

It is another object of the present invention to provide a wall mounting system that will allow customization of the placement of brackets thereon.

It is still another object of the present invention to provide a wall mounting system which has a pleasing aesthetic appearance.

The above summary, as well as further objects, features, and advantages of the present invention will be more fully understood when taken in conjunction with the accompanying drawings described below and the following detailed description of the preferred embodiments.

Figure 1:
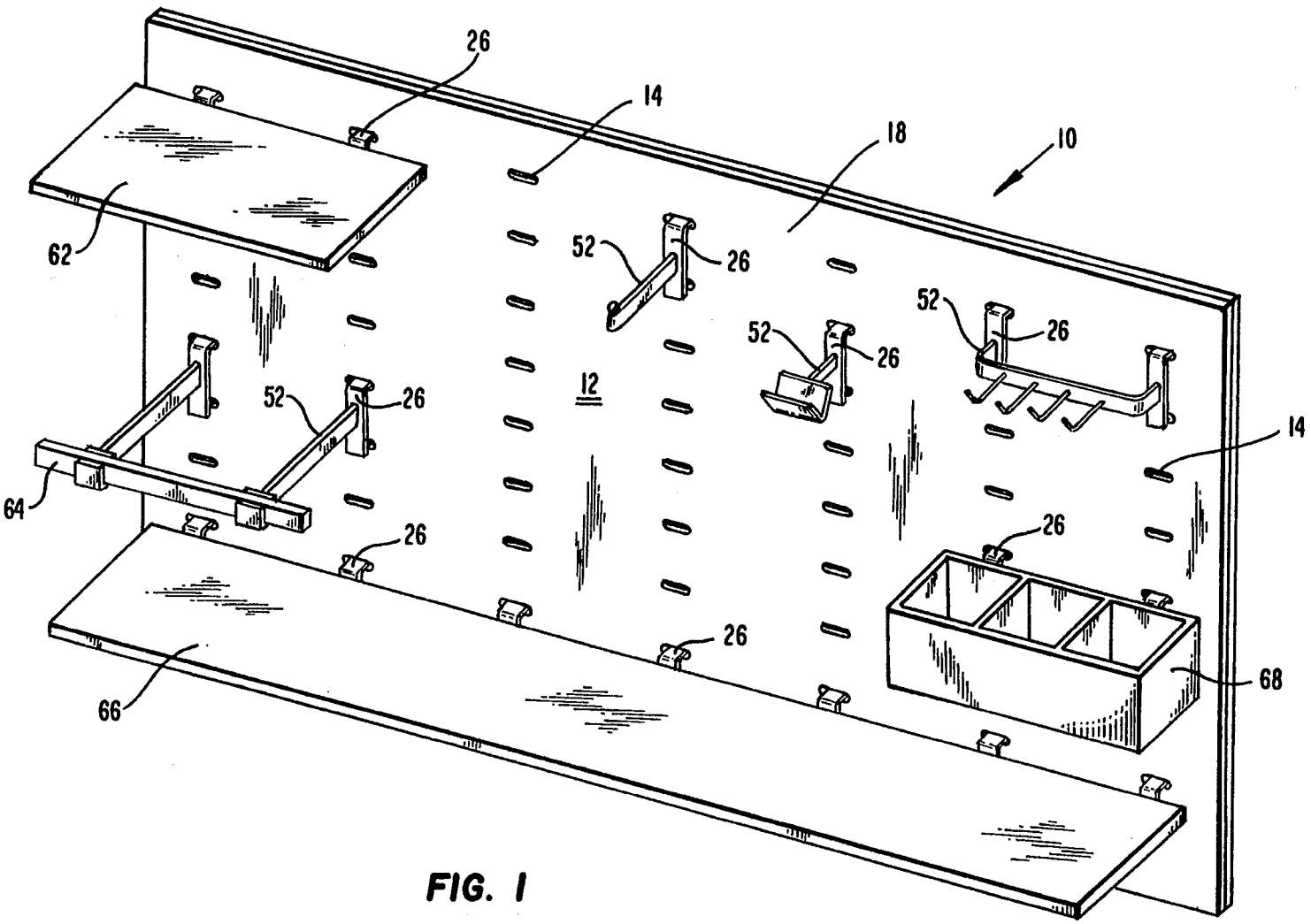
FIG. 1 is a perspective view of a preferred embodiment of the wall mounting system of the present invention in assembled position.

Thus, as can be appreciated from FIG. 1, the wall mounting system 10 comprises a unique arrangement of mounting devices that can be customized to suit the particular needs of a user. In this regard, various articles, such as articles of clothing, picture frames, porcelain figurines and other giftware and miscellaneous articles, can be simultaneously displayed according to a desired layout. For example, the wall mounting system 10 is shown in FIG. 1 as comprising a plurality of brackets 26 upon which is mounted a typical shelf 62, a hang bar 64 a countertop 66 and a display cubical 68. Additionally, several different types of brackets 26 including several different types of articles support members 52 are illustrated in FIG. 1 as a means for displaying belts, pictures, clothing, and other articles.

DETAILED DESCRIPTION OF THE PREFERRED EMBODIMENTS

A wall mounting system in accordance with one preferred embodiment of the present invention is shown in FIGS. 1–7. The wall mounting system is generally designated 10 as shown in assembled position in FIG. 1. In this preferred embodiment, the wall mounting system 10 is shown as comprising a wall fixture 12, and a plurality of brackets, some of which have an additional display support structure such as a shelf, a hang bar, a countertop and a cubicle supported thereon.

Figure 3:
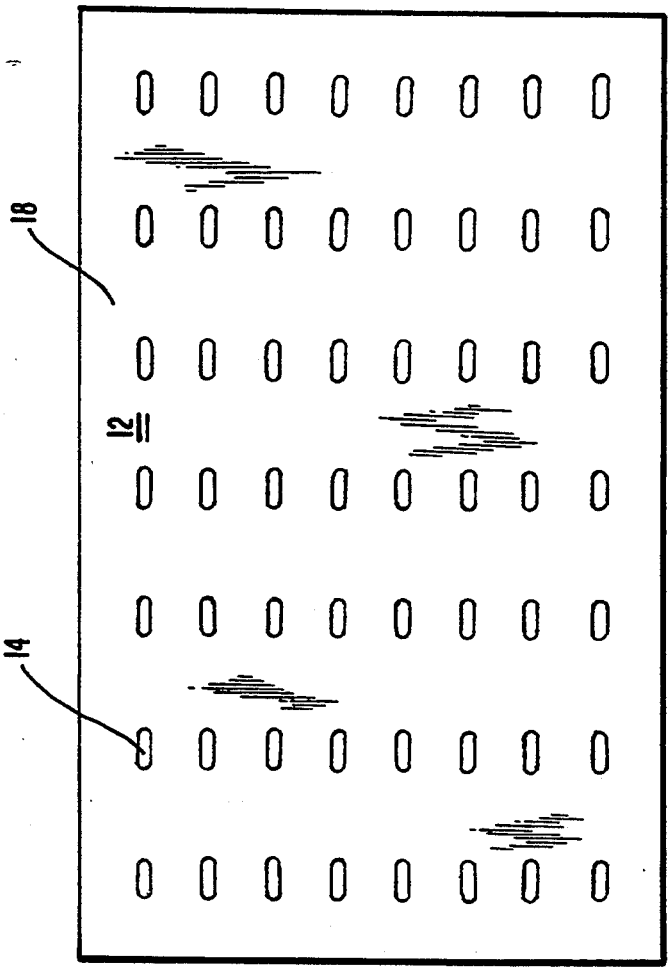
FIG. 3 is a front view of a wall fixture of the present invention.
Figure 2:
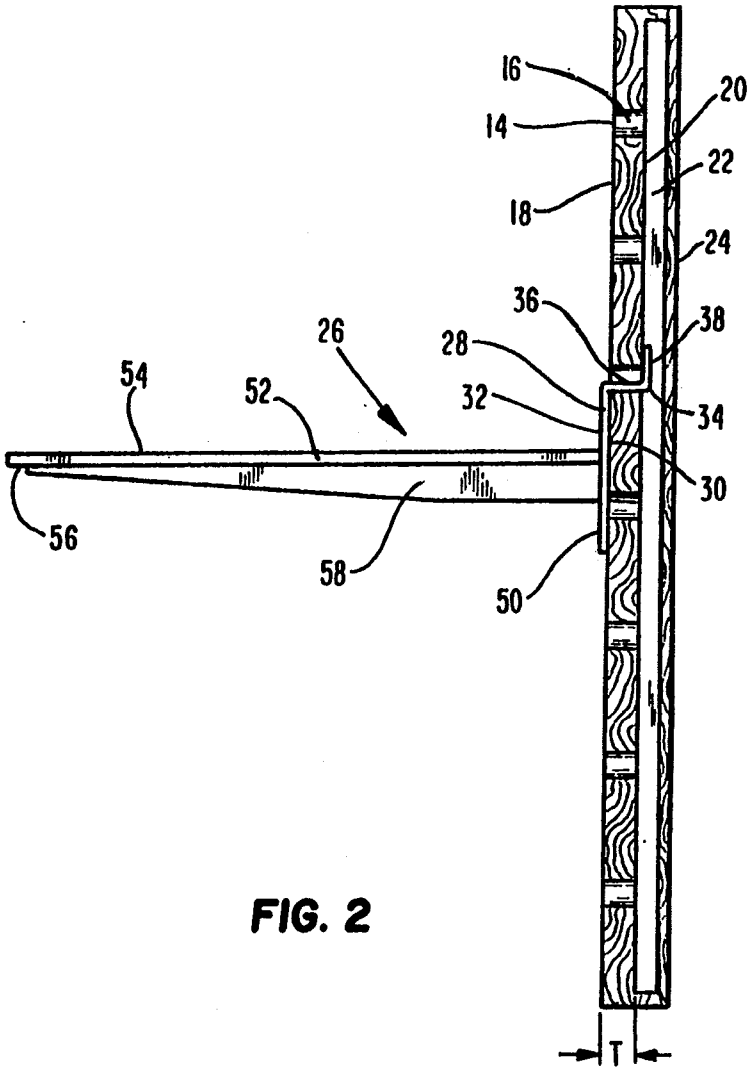
FIG. 2 is a side cross sectional view of the mounting system shown in FIG. 7 taken along line 2—2 thereof.

In the preferred embodiment shown in FIGS. 1–3, the wall fixture 12 comprises a rectangular parallelopiped structure having a plurality of spaced elongate apertures 16 on the external front surface 18 thereof. It should be appreciated that the wall fixture 12 can be manufactured in a variety of shapes and sizes. For example, it may comprise an oval shape, a triangular shape, circular shape, etc. As best shown in FIG. 2, the plurality of passageways 16 are aligned with corresponding ones of the elongate apertures 14. The passageways 16 extend through a portion of the body of the wall fixture 12 to a hollow cavity 22 therein.

An internal wall 20 defines the dimensions of the cavity 22. An external rear wall 24 is arranged on the wall fixture 12 so that the cavity 22 is enclosed and thus, the wall fixture appears as a solid body with elongate apertures 14 therein. It should be appreciated that the external rear wall 24 is an optional feature of the present invention, that may be connected to the front wall so that the wall fixture will have a more attractive appearance. Preferably, the wall fixture 12 is made of wood material; such as solid wood, particle board or veneer. The wooden construction results in a particularly pleasing aesthetic appearance. However, in alternate embodiments, the wall fixture 12 may be made of plastic, metal, ceramic, or other relatively rigid materials.

Figure 4:
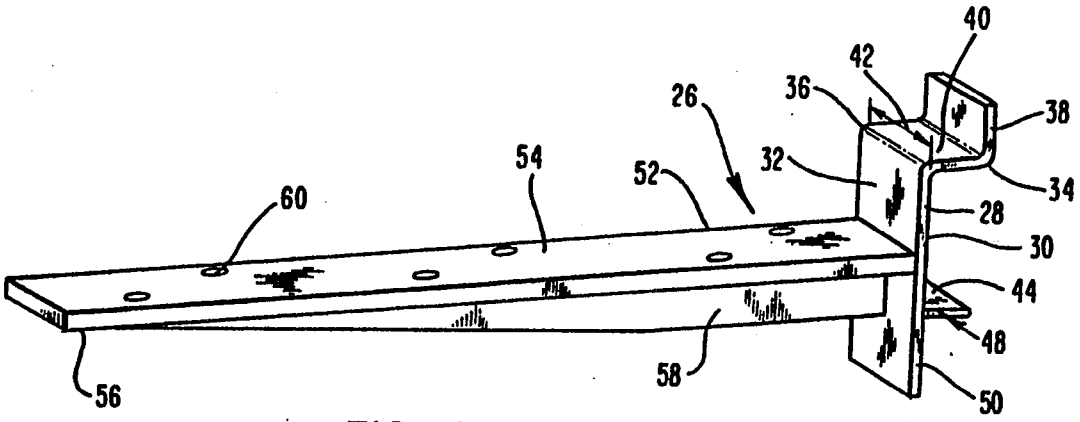
FIG. 4 is a perspective view of a bracket of the present invention.
Figure 5:
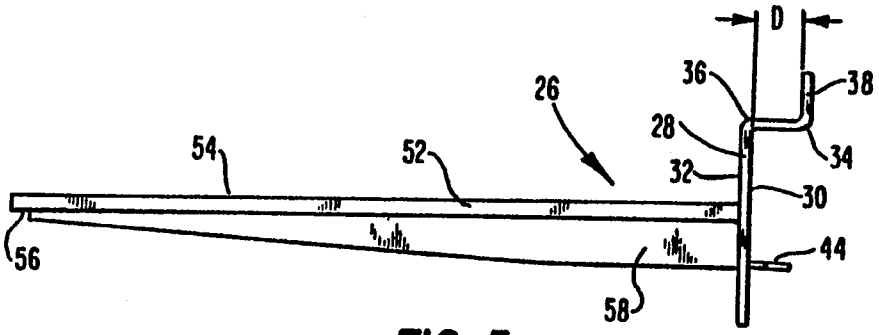
FIG. 5 is a side view of the bracket shown in FIG. 4.
Figure 6:
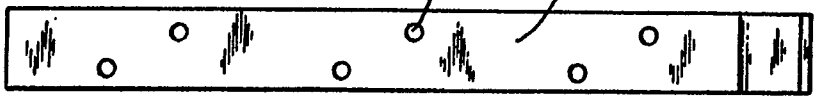
FIG. 6 is a top plan view of the bracket shown in FIGS. 4 and 5.

One example of a bracket 26 that is suitable for use in connection with the present invention is generally shown in FIGS. 4–6. The bracket 26 is adapted to be uniquely mounted on the wall fixture 12 so that a particularly stable arrangement is achieved. The bracket 26 may be made of various materials having the required rigidity and strength to permit the bracket to be firmly mounted within the wall fixture 12 and to support an associated article thereon. In a preferred embodiment, the bracket 26 is made of a metal such as steel, iron or aluminum. However, the bracket 26 may also be made of wood, plastic, ceramic, and the like.

As shown in FIGS. 1 and 4–6, the bracket 26 includes a central member 28 which is oriented to extend along a vertical plane when the bracket 26 is in assembled position. The central member 28 has an inner side 30 and an outer side 32. A plurality of support members including upper support member 34 and lower support member 44 extend inwardly from the inner side 30 of the central member 28. When the bracket 26 is in assembled position on the wall fixture 12 the inner side 30 of the central member 28 will abut the external front wall 18 of the bracket 26. This feature of the present invention is best shown in FIG. 2.

The upper support member 34 is L-shaped and is preferably connected to the uppermost location of the central member 28. As best shown in FIGS. 4 and 5, the upper support member 34 includes a horizontally extending member 36 and vertically extending locking member 38 integrally attached to the horizontal member 36. Significantly, the L-shaped upper support member 34 has a planar surface 40 thereon which defines a predetermined width 42. As will be discussed in more detail hereinbelow, the width 42 preferably corresponds closely with the width of a corresponding one of the elongate apertures 14 and the passageways 16.

In a preferred embodiment, the thickness of a portion of the wall fixture 12 defined by passageways 16, i.e., the portion of the wall fixture 12 between the internal surface 20 and the external front surface 18, is selected to closely correspond with the distance that the vertically extending locking member 38 is spaced from the inner side 30 of the central member 28. This aspect of the present invention can best be appreciated from FIGS. 2 and 5 wherein the thickness T of the wall fixture 12 between the external front surface 18 and the internal surface 20 is shown as closely corresponding to the distance D between the inner side 30 of the central member 28 and the outer planar surface of the vertically extending locking member 38.

A lower support member 44 also extends inwardly from the inner side 30 of central member 28. The lower support member 44 has a planar surface 46 thereon. The planar surface 46 defines a width 48 which is preferably the same size or approximately the same size of the width 42 of the upper support member 34. Thus, the width 42 is also selected to closely correspond with the size of a corresponding one of the elongate apertures 14 and passageways 16. This feature is particularly important to provide the desired degree of stability between the bracket 26 and the wall fixture 12 when they are arranged in assembled position.

In one preferred embodiment, the widths 42 and 48 of the corresponding upper and lower support members 34 and 44, may be between about 1 and 1½ inches, and preferably approximately 1¼ inches. Each of the elongate apertures 14 and the passageways 16 may have a closely corresponding width of between about 1 and 1½ inches, and preferably approximately 1¼ inches. It should be appreciated that the apertures 14 and corresponding passageways 16 may have an oval-shaped cross section as shown in FIGS. 1 and 3 or, alternatively, may have a rectangular cross section (not shown) or other suitable cross section. In the preferred embodiment shown in FIGS. 1 and 3, the width of the apertures 14 and the passageways 16 correspond to the relatively planar portion of the opening which is adapted to be placed in contact with corresponding planar surfaces 40 and 46 of respective upper support member 34 and lower support member 44. If it is desirable to utilize an embodiment wherein the apertures and passageways have rectangular cross sections, the width described herein will pertain to the entire width from end to end of the rectangular opening.

One embodiment of a bracket 26 used in the present invention is shown in FIGS. 4 and 5. This bracket includes an article support member 52 depicted as a planar shelf support, which extends transversely and outwardly from the outer side 32 of the central member 28 along a horizontal plane. In this embodiment, the article support member 52 includes an upper planar surface 54 for supporting a shelf thereon, and a lower planar surface 56. A central axis extends through the article support member 52 between the upper and lower planar surfaces 54 and 56, and is arranged transverse to the central member 28. Various other embodiments of brackets suitable for use in the present invention is shown in assembled position in FIG. 1. In this regard, it should be understood that the article support member 52 of the shelf support bracket 26 described above and shown in FIGS. 4 and 5 is merely an example of one suitable type of article support member 52 for an associated bracket 26. Other examples of suitable article support members 52 for brackets 26 include article support members associated with belt hook brackets, picture holder brackets, brackets for supporting a hang bar, face-out brackets, etc. The common feature between all of the brackets 26 relates to the structure which facilitates a secure mounting arrangement on the wall fixture 12, as describe above. The article support member 52 of the brackets 26 may vary in accordance with the need to display various articles.

With regard to the shelf support bracket 26, additional features may include a support fin 58 centrally arranged below the lower surface 56 of the article support member 52 and extends coaxially with the central axis thereof. The support fin 58 is also connected to the outer side 32 of the central member 28 so as to provide additional strength and stability to the article support member 52. Thus, the support fin 58 is particularly useful in applications where the load exerted upon the article support member 52 is particularly heavy. The support fin 58 may be connected to the lower surface 56 of the article support member 52 and the outer side 32 of the central member 28 in any conventional manner such as by spot welding or the like.

As best shown in FIGS. 4 and 6, when the article support member 52 is a shelf support member, it may comprise a plurality of spaced circular apertures 60 extending between the upper surface 56 and the lower surface 56 thereof. The apertures 60 are particularly useful when it is desired to secure a shelf to the article support member 52.

According to a preferred embodiment of the shelf mounting system 10, the thickness T (FIG. 2) between the external front surface 18 and the internal surface 20 of the wall fixture 12 should preferably be at least about ½ inches thereto. This may be compared, for example, to standard pegboard, which is only about ⅛ inches thick. Preferably, the thickness T will be between about ½ and up to about ⅝ inches thick. As discussed above, it is desirable for the thickness T to closely correspond with the distance D (FIG. 5) between the inner side 30 of the central member 28 and the outer planar surface of the vertically extending locking member 38. Thus, in one preferred embodiment the distance D may be about ½ inches.

Further, the elongate apertures 14 may be equidistantly spaced as clearly shown in FIGS. 1 and 3. In the preferred embodiment of the wall mounting system 10 described herein, the distance between adjacent apertures 14 would be such that in the horizontal direction between vertical rows of apertures 14 these rows will preferably have either approximately 15 inch centers or approximately 22 inch centers, and in the vertical direction between each of the apertures 14 in a given such centered row of apertures the distance will be approximately 2 inches. This distance preferably closely corresponds with the distance between the horizontally extending portion 36 of the upper support member 34 and the lower support member 44. Thus, in the preferred embodiment described herein, this distance may be about 2 inches. As can be appreciated, the distance between the upper and lower support members must always be at least as large, and preferably slightly larger, than the distance between adjacent apertures so that proper mounting of the brackets 26 on corresponding wall fixtures 12 can be achieved.

In operation the wall fixture 12 of the mounting system 10 is secured to a wall as shown in FIG. 1. As discussed above, the particular arrangement between the brackets 26 and the wall fixture 12 enhances the stability and securability between these modular components at a superior level than has heretofore been achieved. A significant aspect of this feature of the present invention is attributed to the widths 42 and 48 of the planar surfaces of the upper and lower support members 34 and 44 which correspond to the width of the opening in the elongate apertures 14 and passageways 16.

The stability between the brackets 26 and the corresponding wall fixtures 12 is also attributed to the close correspondence between the thickness T between the external front surface 18 and the internal surface 20 of the wall fixture 12, and the distance D between the inner side 30 of the central member 28 and the outer planar surface of the vertically extending locking member 38. Although this close correspondence between the thickness T and the distance D is an optional feature of the present invention, it should be appreciated that optimal operation of the shelf mounting system 10 is achieved when the distance D is slightly larger than the thickness T. Thus, it is highly desirable for the sizes of the thickness T and the distance D to closely correspond to each other so that there will be little or no movement between the brackets 26 and the wall fixture 12 when they are placed in assembled position as shown in FIGS. 1 and 2.

The brackets 26 are placed in assembled position with respect to a corresponding wall fixture 12 by initially aligning the locking member 38 with a desired aperture 14. At this time, the article support member 52 should extend generally coplanar with the external front surface 18 of the wall fixture 12. The bracket 26 should then be rotated downwardly until the lower support member 44 and the horizontal portion 36 of the upper support member 34 extend through their corresponding apertures and passageways. Once the bracket 26 is assembled in the corresponding wall fixture 12, the inner side 30 of central member 28 will abut the external front wall 18 of the wall fixture 12. Additionally, when the bracket 26 is assembled on the wall fixture 12, the planar surface of the locking member 38 will abut the internal wall 20 within the cavity 22. This structure is significant as the cooperation between the locking member 38 and the internal wall 20 facilitates the particularly secure relationship between the bracket 26 and the wall fixture 12. As best shown in FIG. 2, the lower portion 50 of the central member 28 abuts the external front wall 18 of the wall fixture 12 as the bracket 26 is placed into assembled position thereon.

As shown in FIGS. 1 and 2, it is preferable for the distance between the horizontal portion 36 of the upper support member 34 and the lower support member 44 to correspond with the distance between respective apertures 14. However, it should be appreciated that the spaced relationship between the support members and the elongate apertures may vary in alternate embodiments whereby additional elongate apertures may exist between the upper and lower support members 34 and 44.

As best shown in FIG. 1, the aligned elongate apertures 14 and passageways 16 have respective widths 42 and 48 which correspond closely to the widths of the respective upper and lower support members 34 and 44. This feature of the present invention is entirely novel with respect to prior art wall mounting systems which merely utilize continuous slots in which bracket members may be mounted to wall fixtures. The use of continuous slots is particularly undesirable because they provide inferior structural support for the brackets as compared to the support provided by the sized and aligned elongate apertures and the mounting members of the present invention.

Additionally, the present invention has the advantage of providing a customized location of the elongate apertures 14 and thus, the brackets 26 and the articles to be displayed thereon. This results in a greatly improved aesthetic appearance over the prior art continuous slot mounting systems.

Once the brackets 26 are placed into assembled position within the corresponding wall fixtures 12, they are firmly secured thereto and thus exhibit very little or no movement therein. In fact, the only manner in which movement can be created between the brackets 26 and the wall fixtures 12 is by exerting an upward force at a part of the lower surface 56 of the article support member 52 that is spaced from the external front wall 18 of the wall fixture 12.

If it is desired to adjust the position of the brackets 26 with respect to a corresponding wall fixture 12, it is only required to simply exert a force, as described above, to the lower surface 56 of the article support member 52. The bracket can then easily be removed from the corresponding apertures 14 and can be placed in different apertures which correspond to a different height along the wall fixture 12. Thus, not only does the present invention provide the advantage of enhancing the stability between the brackets 26 and the wall fixtures 12, it also facilitates simple adjustability and removal of the brackets 26 with respect to the wall fixtures 12.

When the brackets 26 and the wall fixtures 12 are placed in assembled position, a desired article or articles need only be placed upon the brackets, or upon supplemental support devices mounted on the article support members 52 of the brackets 26, to complete the assembly. If a shelf is to be mounted on the brackets 26, it can optionally be secured to the associated article support members 52 via mounting hardware (not shown) which are adapted to extend through the apertures 60 which extend between the upper and lower surfaces 54 and 56 of the article support member 52.

Figure 7:
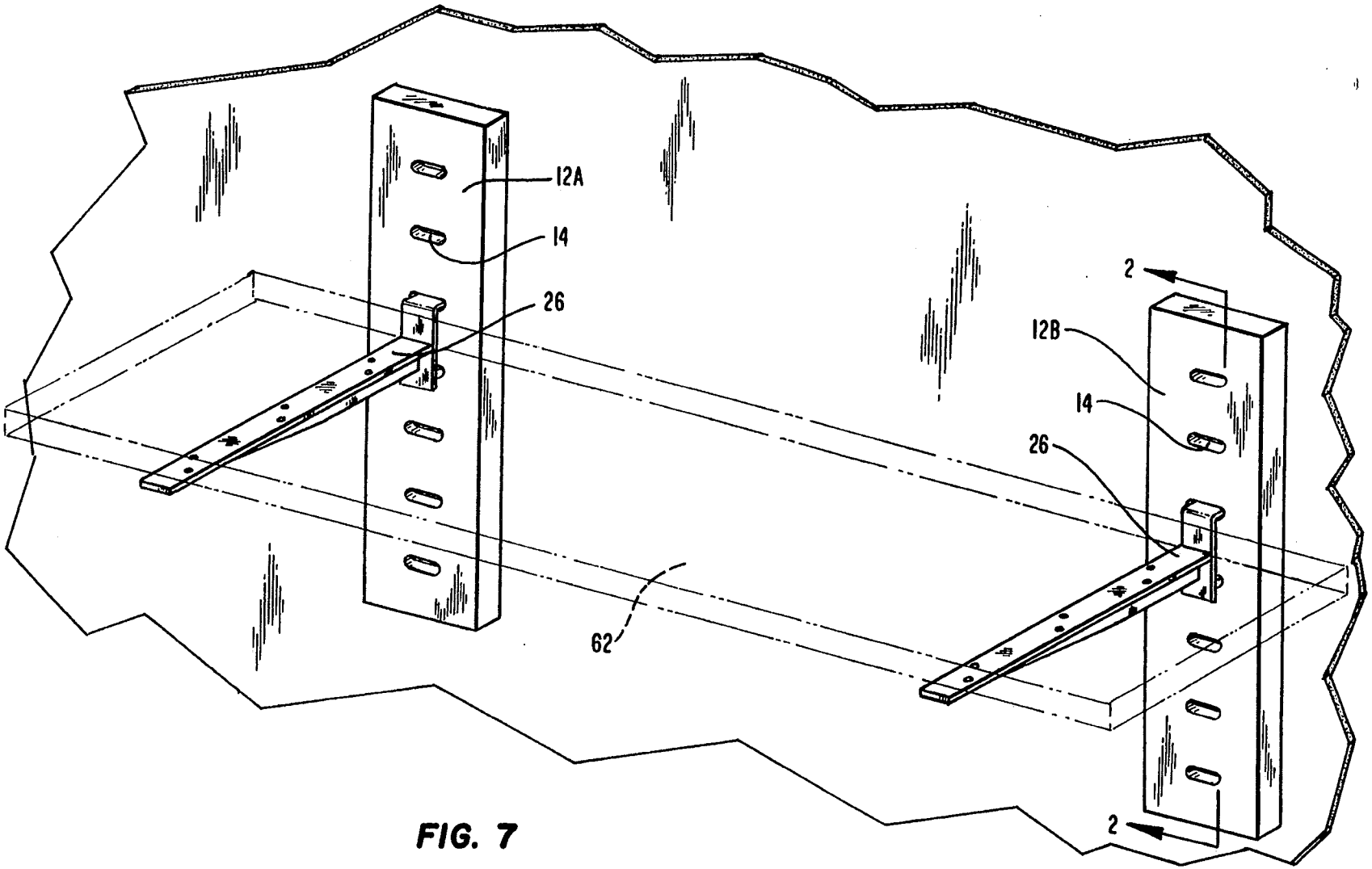
FIG. 7 is a perspective view of a second embodiment of the wall mounting system of the present invention in assembled position.

An alternate preferred embodiment of the wall mounting system of the present invention is shown in FIG. 7 as comprising a pair of wall fixtures 12 and a plurality of brackets 26 having associated article support members 52 supporting a shelf thereon. This embodiment of the present invention may be desirable to those who wish to obtain the advantageous structural advantages and aesthetic appearance of the present wall mounting system in their homes, office, or other areas where space may be limited. Of course, preferred embodiment of the wall mounting system 10 shown in FIG. 1 can also be used for these purposes.

While the foregoing description and figures are directed toward the preferred embodiments in accordance with the present invention, it should be appreciated that numerous modifications can be made to each of the components of the mounting system 10. Indeed, such modifications are encouraged to be made in materials, structure and arrangement of the present invention without departing from the spirit and scope of the same. Thus, the foregoing description of the preferred embodiments should be taken by way of illustration rather than by way of limitation with respect to the present invention as defined by the claims set forth below.

What is claimed is:

1. A wall mounting system comprising:

bracket means for supporting at least one article thereon, said bracket means including a central member extending in a vertical plane, said central member having an inner side and an outer side, a plurality of mounting members attached to said central member at spaced locations thereon and having at least a horizontally extending portion thereof extending inwardly from said inner side thereof in a horizontal plane generally transverse to said central member, each of said mounting members having a generally planar surface defining a predetermined width thereacross, and an article support member attached to said central member and extending outwardly from said outer side thereof; and wall fixture means for supporting said bracket means thereon, said wall fixture means comprising an internal surface and an external surface and a plurality of elongate apertures extending therebetween for receiving corresponding ones of said plurality of mounting members, said plurality of elongate apertures having a width substantially corresponding to said predetermined width of said planar surfaces of said corresponding mounting members so that said bracket means is firmly mounted on said wall fixture means when arranged in assembled position.

2. The wall mounting system of claim 1 wherein said wall fixture means is adapted to be secured to a wall.

3. The wall mounting system of claim 1 wherein said wall fixture means comprises a portion of a wall.

4. The wall mounting system of claim 1 wherein said wall fixture means further includes an exterior rear wall distal from said internal surface for enclosing said internal surface of said wall fixture means.

5. The wall mounting system of claim 1 wherein said plurality of mounting members comprises an upper member and a lower member, said upper member being L-shaped and including a locking member extending transversely to said horizontally extending portion, said locking member being integral with said horizontally extending portion and being spaced from said inner side of said central member a distance substantially corresponding to the thickness of said wall fixture means between said internal surface and said external surface thereof so that when said locking member extends through a corresponding one of said elongate apertures it engages said internal surface of said wall fixture means so as to stabilize said bracket means thereon.

6. The wall mounting system of claim 5 wherein the distance between said upper and lower mounting members is selected so that said inner surface of said central member abuts said external surface of said wall fixture means when said bracket means is arranged in assembled position.

7. The wall mounting system of claim 6 wherein said central member extends downwardly below said horizontal plane of said lower support member.

8. The wall mounting system of claim 5 wherein said central member has an upper end and a lower end, said upper support member being integral with said central member at said upper end.

9. The wall mounting system of claim 1 wherein said wall fixture means is made of fibrous material.

10. The wall mounting system of claim 5 wherein said wall fixture means comprises at least one parallelopiped structure, said at least one parallelopiped structure having a central cavity therein, said bracket means comprising a plurality of brackets, said locking member of each of said plurality of brackets being arranged within a corresponding one of said plurality of apertures and extending into said central cavity so that said locking member abuts said internal surface of said wall fixture means when placed in assembled position.

11. The wall mounting system of claim 1 wherein said article support member comprises a shelf support member having a center axis extending parallel to said horizontal planes of said plurality of mounting members, said shelf support member having an upper surface adapted to support said shelf thereon and a lower surface.

12. The wall mounting system of claim 11 wherein said center axis of said shelf support member intersects said vertical plane of said central member at a location between said upper support member and said lower support member.

13. The wall mounting system of claim 1 wherein said article support member includes at least one elongate member adapted to support at least one article thereon.

14. The wall mounting system of claim 1 wherein said article support member comprises a picture holder.

15. The wall mounting system of claim 12 wherein said wall fixture means comprises a pair of parallelopiped structures, each of said parallelopiped structures having a central cavity therein, said brackets means comprising a pair of brackets corresponding to respective ones of said pair of parallelopiped structures, said locking member of each of said pair of brackets being arranged within a corresponding one of said plurality of apertures and extending into said central cavity so that said locking member abuts said internal surface of said wall fixture means when placed in assembled position, said pair of parallelopiped structures being adapted to be mounted on a wall at predetermined spaced distances from each other, said corresponding ones of said pair of brackets being mounted on said pair of parallelopiped structures whereby the shelf to be supported thereon is arranged to extend between said shelf support members of said pair of brackets.

16. The wall mounting system of claim 11 wherein said shelf support member includes a plurality of apertures extending between said upper surface and said lower surface, said shelf mounting system further comprising mounting hardware adapted to extend between said apertures so that said shelf can be securely mounted on said shelf support members.

* * * * *